US008297240B2

(12) United States Patent
Inoue et al.

(10) Patent No.: US 8,297,240 B2
(45) Date of Patent: Oct. 30, 2012

(54) VARIABLE VALVE TIMING CONTROL APPARATUS FOR INTERNAL COMBUSTION ENGINE

(75) Inventors: Masaomi Inoue, Kariya (JP); Yuichi Takemura, Toyohashi (JP)

(73) Assignee: Denso Corporation, Kariya (JP)

( * ) Notice: Subject to any disclaimer, the term of this patent is extended or adjusted under 35 U.S.C. 154(b) by 392 days.

(21) Appl. No.: 12/787,853

(22) Filed: May 26, 2010

(65) Prior Publication Data

US 2010/0305835 A1 Dec. 2, 2010

(30) Foreign Application Priority Data

May 27, 2009 (JP) ..... 2009-128351

(51) Int. Cl.
*F01L 1/00* (2006.01)

(52) U.S. Cl. ..... 123/90.1; 123/90.15

(58) Field of Classification Search ..... 123/90.1, 123/90.15–90.18, 345–348, 321
See application file for complete search history.

(56) References Cited

U.S. PATENT DOCUMENTS

| | | | | |
|---|---|---|---|---|
| 5,738,056 | A | 4/1998 | Mikame et al. | |
| 6,247,434 | B1 * | 6/2001 | Simpson et al. | 123/90.17 |
| 6,318,313 | B1 * | 11/2001 | Moriya et al. | 123/90.15 |
| 6,330,870 | B1 | 12/2001 | Inoue et al. | |
| 6,374,787 | B2 * | 4/2002 | Simpson et al. | 123/90.17 |
| 6,435,149 | B2 * | 8/2002 | Moriya et al. | 123/90.18 |
| 2001/0027763 | A1 * | 10/2001 | Simpson et al. | 123/90.17 |
| 2002/0100442 | A1 | 8/2002 | Takahashi et al. | |
| 2008/0011256 | A1 | 1/2008 | Wright | |

FOREIGN PATENT DOCUMENTS

| | | |
|---|---|---|
| JP | 3701095 | 7/2005 |
| JP | A-2005-226534 | 8/2005 |

OTHER PUBLICATIONS

Japanese Office Action dated Aug. 8, 2011, issued in corresponding Japanese Application No. 2009-128351 with English Translation.

* cited by examiner

*Primary Examiner* — John Kwon
(74) *Attorney, Agent, or Firm* — Nixon & Vanderhye PC

(57) ABSTRACT

A variable valve timing control apparatus for an internal combustion engine having a crankshaft and a camshaft, the variable valve timing control apparatus including a hydraulic variable valve timing device, an intermediate lock mechanism, and an oil pressure control device. The control apparatus learns an intermediate lock position to obtain a learning value of the intermediate lock position when the intermediate lock mechanism locks the VCT phase at the intermediate lock position. The control apparatus computes an actual VCT phase based on the learning value of the intermediate lock position. The control apparatus computes a target VCT phase in accordance with an operational condition of the engine based on the learning value of the intermediate lock position. The control apparatus controls a control amount of the oil pressure control device such that the actual VCT phase becomes the target VCT phase.

8 Claims, 10 Drawing Sheets

B1: INT. LOCK POSITION LEARNING VALUE [SPECIFIC CRANK ANGLE BASED]

B2: INT. LOCK POSITION LEARNING VALUE [FULL RETARD POSITION BASED]

B3: FULL RETARD POSITION LEARNING VALUE [SPECIFIC CRANK ANGLE BASED]

VARIABLE VALVE TIMING CONTROL APPARATUS FOR INTERNAL COMBUSTION ENGINE

CROSS REFERENCE TO RELATED APPLICATION

This application is based on and incorporates herein by reference Japanese Patent Application No. 2009-128351 filed on May 27, 2009.

BACKGROUND OF THE INVENTION

1. Field of the Invention

The present invention relates to a variable valve timing control apparatus for an internal combustion engine, which apparatus includes an intermediate lock mechanism that locks a rotational phase of a camshaft relative to a crankshaft of the engine at an intermediate lock position. The rotational phase is referred to as a "variable cam timing (VCT) phase" in the present specification, and typically, the intermediate lock position is located between a full retard position and a full advance position of an adjustable range of the rotational phase.

2. Description of Related Art

In a conventional hydraulic variable valve timing device, as shown in JP-A-H9-324613 (corresponding to U.S. Pat. No. 5,738,056) and JP-A-2001-159330 (corresponding to U.S. Pat. No. 6,330,870), a lock position during engine stop is set at a generally middle phase within an adjustable range of a VCT phase such that the adjustable range of valve timing (VCT phase) is enlarged. In the above conventional art, the above intermediate lock position, at which the phase is locked during the engine stop, is set at a phase suitable for starting the engine. The engine is started while the VCT phase is at the intermediate lock position. Also, when oil pressure have been raised to a preferable pressure due to the increase of the engine rotational speed (oil pump rotational speed) after starting the engine, the lock is released such that valve timing (VCT phase) is feed-back controlled. In the above, an actual VCT phase is computed based on the pulse signals that are outputted synchronously with the engine rotation from rotation angle sensors (a cam angle sensor and a crank angle sensor). Thus, actuation oil pressure of the variable valve timing device is feed-back controlled such that the actual VCT phase, which has been released from the lock position, becomes a target VCT phase that is set in accordance with the engine operational state.

In the above, as described in JP3699654 (corresponding to US2002/0100442), in the computation of the actual VCT phase and the target VCT phase, the full retard position or the full advance position is set as a reference phase (0°CA) to compute the actual VCT phase and the target VCT phase.

As above, in the variable valve timing device having an intermediate lock mechanism, during the engine start operation of the engine, the engine is started while the VCT phase is locked at the intermediate lock position. Accordingly, after the engine start operation has been completed, it requires a certain amount of time before the engine begins to be operated under a specific operational state for learning the reference phase (the full retard position or the full advance position). Thus, until the reference phase has been learned after the engine start, the VCT phase has to be controlled with the unknown reference phase, and thereby it is impossible to accurately control the VCT phase disadvantageously.

Also, a recent on-board computer is typically provided with a back-up RAM that is capable of keeping data by using an on-board battery as the back-up power source even while the ignition switch is off (or while the engine is at rest or is deactivated). When the learning operation of the reference phase has been completed, data of the reference phase learning value is stored in the back-up RAM. Thus, the on-board computer will compute the actual VCT phase and the target VCT phase by using the reference phase learning value stored in the back-up RAM after the engine start in the next operation.

However, in an accident, where data stored in the back-up RAM is cleared due to the disconnection from the back-up power source caused by the erroneous detachment of the on-board battery while the ignition switch is off, data of the reference phase learning value is also cleared. As a result, during a period until the reference phase has been learned after the engine start, the VCT phase has to be controlled under a state, where the reference phase is unknown, and thereby it is impossible to accurately control the VCT phase disadvantageously.

SUMMARY OF THE INVENTION

The present invention is made in view of the above disadvantages. Thus, it is an objective of the present invention to address at least one of the above disadvantages.

To achieve the objective of the present invention, there is provided a variable valve timing control apparatus for an internal combustion engine having a crankshaft and a camshaft, the variable valve timing control apparatus including a hydraulic variable valve timing device, an intermediate lock mechanism, an oil pressure control device, intermediate lock position learning means, actual VCT phase computing means, target VCT phase computing means, target VCT phase computing means and variable valve timing controlling means. The hydraulic variable valve timing device is configured to adjust valve timing by changing a variable cam timing (VCT) phase that is a rotational phase of the camshaft relative to the crankshaft. The intermediate lock mechanism is configured to lock the VCT phase at an intermediate lock position located between a full retard position and a full advance position of an adjustable range of the VCT phase. The oil pressure control device is configured to control oil pressure that actuates the variable valve timing device and the intermediate lock mechanism, wherein the oil pressure control device causes the intermediate lock mechanism to lock the VCT phase at the intermediate lock position when rotation of the internal combustion engine is to be stopped. The intermediate lock position learning means learns the intermediate lock position as a reference phase to obtain a learning value of the intermediate lock position when the intermediate lock mechanism locks the VCT phase at the intermediate lock position. The actual VCT phase computing means computes an actual VCT phase based on the learning value of the intermediate lock position. The target VCT phase computing means computes a target VCT phase in accordance with an operational condition of the internal combustion engine based on the learning value of the intermediate lock position. The variable valve timing controlling means controls a control amount of the oil pressure control device such that the actual VCT phase becomes the target VCT phase.

To achieve the objective of the present invention, there is also provided a variable valve timing control apparatus for an internal combustion engine having a crankshaft and a camshaft, the variable valve timing control apparatus including a hydraulic variable valve timing device, an intermediate lock mechanism, an oil pressure control device, intermediate lock position learning means, limit position provisional value computing means, actual VCT phase computing means, target VCT phase computing means, and variable valve timing controlling means. The hydraulic variable valve timing device is configured to adjust valve timing by changing a variable cam timing (VCT) phase that is a rotational phase of the camshaft relative to the crankshaft. The intermediate lock mechanism is configured to lock the VCT phase at an intermediate lock position located between a full retard position and a full advance position of an adjustable range of the VCT phase. The oil pressure control device is configured to control oil pressure that actuates the variable valve timing device and the intermediate lock mechanism, wherein the oil pressure control device causes the intermediate lock mechanism to lock the VCT phase at the intermediate lock position when rotation of the internal combustion engine is to be stopped. The intermediate lock position learning means learns the intermediate lock position as a reference phase to obtain a learning value of the intermediate lock position when the intermediate lock mechanism locks the VCT phase at the intermediate lock position. The limit position provisional value computing means computes a provisional value of a limit position of the adjustable range of the VCT phase based on the learning value of the intermediate lock position, the limit position being located on a retard side or on an advance side of the adjustable range of the VCT phase. The actual VCT phase computing means computes an actual VCT phase based on the provisional value of the limit position. The target VCT phase computing means computes a target VCT phase in accordance with an operational condition of the internal combustion engine based on the provisional value of the limit position. The variable valve timing controlling means controls a control amount of the oil pressure control device such that the actual VCT phase becomes the target VCT phase.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

The first and second embodiments, which apply the present invention to a variable valve timing control apparatus for adjusting an intake valve, will be described below.

(First Embodiment)

The first embodiment of the present invention will be described with reference to FIGS. 1 to 7.

Figure 1:
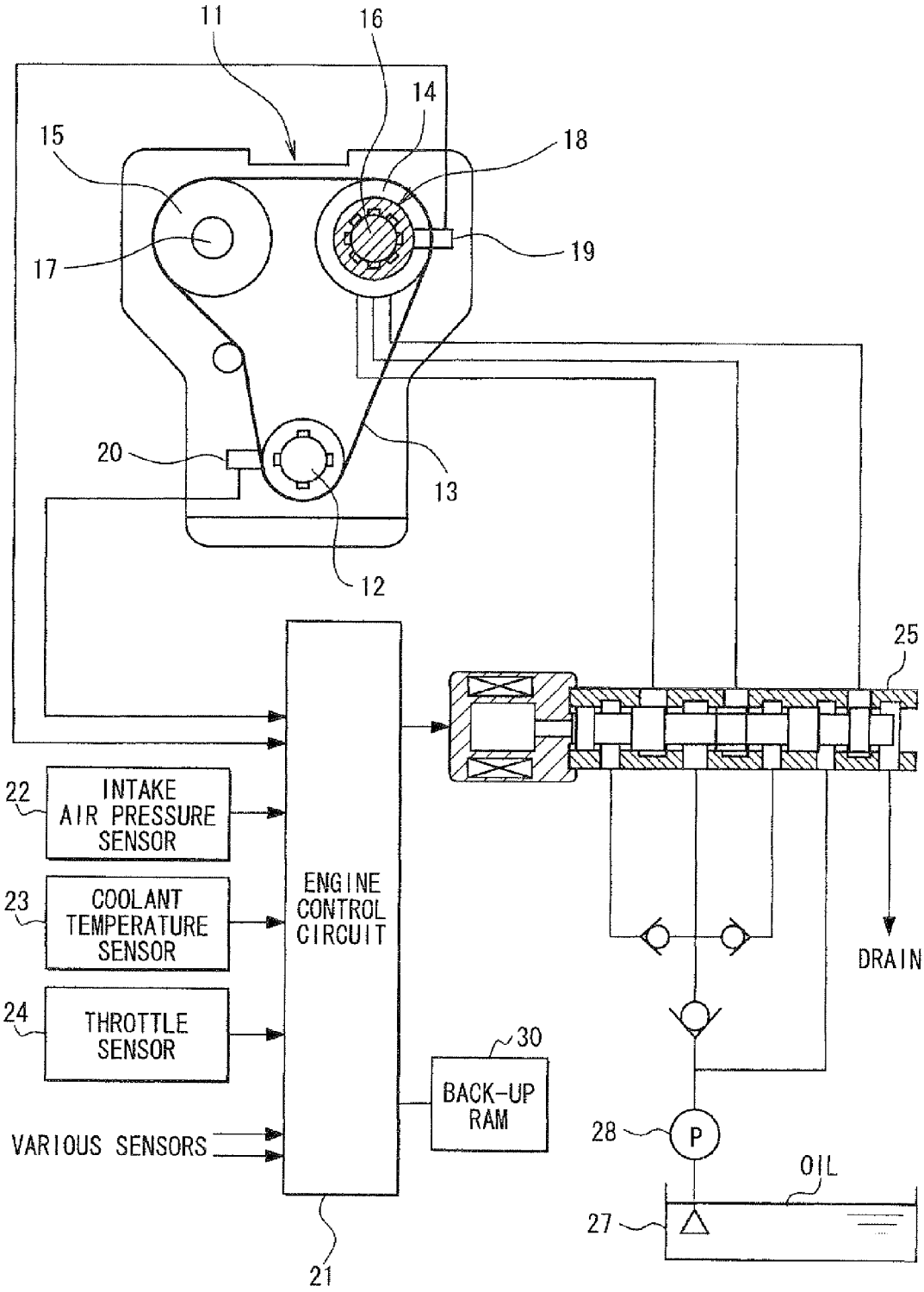
FIG. 1 is a schematic configuration generally illustrating a control system according to the first embodiment of the present invention.

As shown in FIG. 1, an engine 11 (internal combustion engine) transmits drive force from a crankshaft 12 to an intake camshaft 16 and an exhaust camshaft 17 through a timing chain 13 and sprockets 14, 15. The intake camshaft 16 is provided with a variable valve timing device 18 (VCT technology) that adjusts an advance amount or a variable cam timing (VCT) phase of the intake camshaft 16 relative to the crankshaft 12. More specifically, the VCT phase is a rotational angular position of the intake camshaft 16 relative to a rotational angular position of the crankshaft 12.

Also, a cam angle sensor 19 is provided at a position radially outward of the intake camshaft 16 for outputting cam pulses at predetermined cam angles in order to identify cylinders. Also, a crank angle sensor 20 is provided at a position radially outward of the crankshaft 12 for outputting crank pulses at predetermined crank angles. The pulses outputted from the cam angle sensor 19 and the crank angle sensor 20 are fed to an engine control circuit 21. The engine control circuit 21 computes actual valve timing (actual VCT phase) of the intake valve and computes an engine rotation speed based on a frequency (pulse interval) of the output pulses of the crank angle sensor 20. Also, the other signals outputted by various sensors (an intake air pressure sensor 22, a coolant temperature sensor 23, a throttle sensor 24) for detecting an engine operational state are fed to the engine control circuit 21.

The engine control circuit 21 executes fuel injection control and ignition control based on the engine operational state detected by the various sensors. Also, The engine control circuit 21 executes variable valve timing control (VCT phase feed-back control), in which the engine control circuit 21 feed-back controls oil pressure that actuates the variable valve timing device 18 such that the actual valve timing of the intake valve (or an actual VCT phase) becomes target valve timing (target VCT phase) determined in accordance with an engine operational state).

Figure 2:
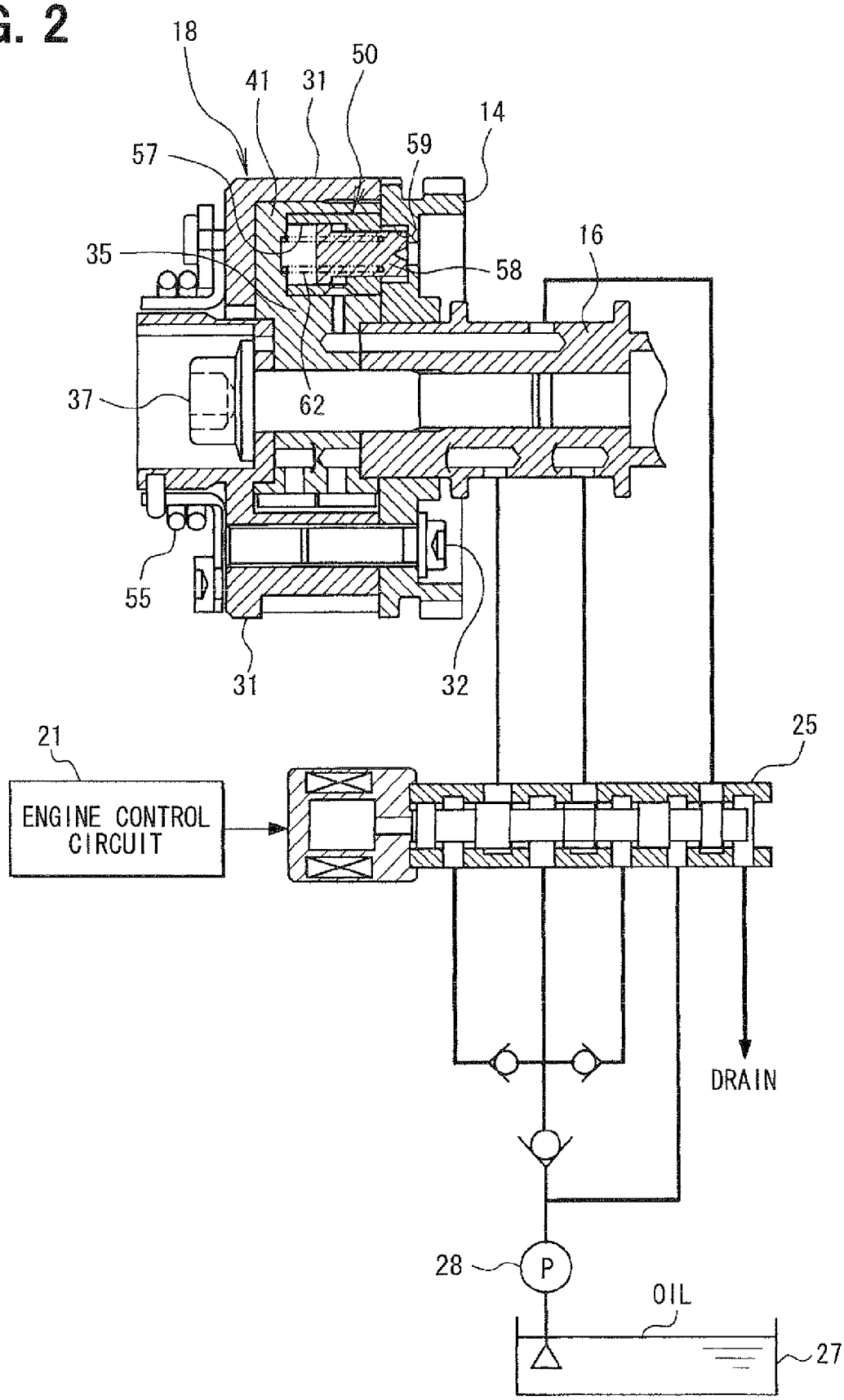
FIG. 2 is a diagram for explaining a variable valve timing device and a hydraulic control circuit (oil pressure control device) of the first embodiment.

Next, the variable valve timing device 18 will be described with reference to FIGS. 2 through 4.

The variable valve timing device 18 has a housing 31 that is fixed to the sprocket 14 through a bolt 32. The sprocket 14 is movably supported at a position radially outward of the intake camshaft 16. Thus, when the rotation of the crankshaft 12 is transmitted to the sprocket 14 and the housing 31 through the timing chain 13, the sprocket 14 and the housing 31 are rotated synchronously with the crankshaft 12.

The intake camshaft 16 has one end portion that is fixed to a rotor 35 through a bolt 37. The rotor 35 is received within the housing 31 and is rotatable relative to the housing 31.

Figure 3:
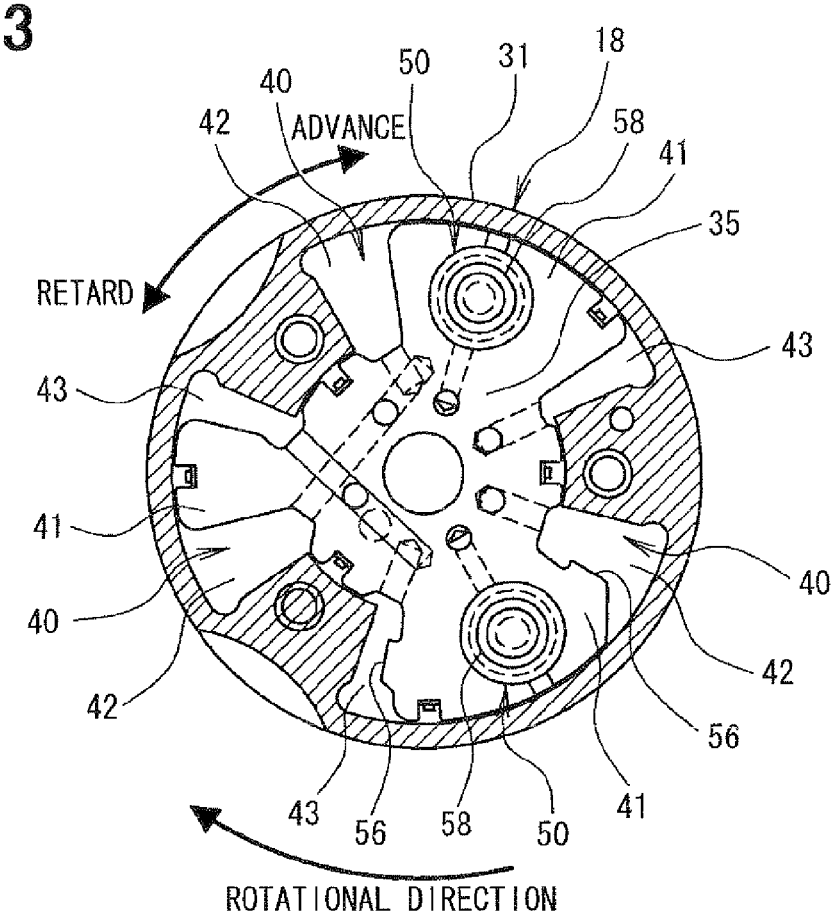
FIG. 3 is a sectional view of the variable valve timing device of the first embodiment taken along a plane perpendicular to a longitudinal axis of the variable valve timing device.

As shown in FIG. 3, multiple vane receiving chambers 40 are formed within the housing 31, and vanes 41 are formed at radially outward parts of the rotor 35. Each of the vane receiving chambers 40 is divided into an advance chamber 42 and a retard chamber 43 by the corresponding vane 41. At least one of the vanes 41 has both circumferential ends that are provided with respective stoppers 56. Each of the stoppers 56 limits a rotational range of the rotor 35 (the vane 41) relative to the housing 31. The stoppers 56 defines a full retard position and a full advance position of an adjustable range of the actual VCT phase (camshaft phase).

The variable valve timing device 18 is provided with an intermediate lock mechanism 50 that is adapted to lock the VCT phase at an intermediate lock position. For example, the intermediate lock position corresponds to a position or a phase between the full advance position and the full retard position (for example, a generally middle position) of the above adjustable range of the VCT phase. The intermediate lock mechanism 50 will be described below. A lock pin receiving hole 57 is provided to one of the multiple vanes 41. Alternatively, multiple lock pin receiving holes 57 may be provided to the multiple vanes 41, respectively. The lock pin receiving hole 57 receives therein a lock pin 58 that is displaceable to project from the lock pin receiving hole 57. The lock pin 58 locks the rotation of the rotor 35 (the vane 41) relative to the housing 31 when the lock pin 58 projects from the lock pin receiving hole 57 toward the sprocket 14 to be inserted into a lock hole 59 of the sprocket 14. As a result, the VCT phase is locked at the intermediate lock position located generally in the middle of the adjustable range. The intermediate lock position is set at a phase that is suitable for starting the engine 11. It should be noted that the lock hole 59 may be alternatively provided to the housing 31.

The lock pin 58 is urged by a spring 62 in a lock direction for locking the VCT phase. In other words, the lock pin 58 is urged in a projection direction, in which the lock pin 58 is capable of projecting from the lock pin receiving hole 57. Also, an oil pressure chamber for releasing the lock is formed between (a) the radially outward part of the lock pin 58 and (b) the lock pin receiving hole 57. The oil pressure chamber is used to control oil pressure that actuates the lock pin 58 in a lock release direction for unlock the rotation of the rotor 35 to release the locked VCT phase. For example, when the pressure in the oil pressure chamber becomes high, the pressure urges the lock pin 58 in the lock release direction such that the lock pin 58 is displaced in the lock release direction against the urging force of the spring 62. Also, when the pressure in the oil pressure chamber becomes low, or is released, the pressure does not urge the lock pin 58 substantially. As a result, the lock pin 58 is urged only in the lock direction by the urging force of the spring 62, and thereby the lock pin 58 is displaced in the lock direction. In the present specification, the operation of urging the lock pin 58 in the lock direction indicates the state, where the pressure in the oil pressure chamber becomes low, and thereby the lock pin 58 is allowed to be displaced in the lock direction as described above. It should be noted that the housing 31 is provided with a spring 55 (see FIG. 2) that provides spring force for assisting oil pressure applied to rotate the rotor 35 relatively in an advance direction during an advance control. The spring 55 may be a helical torsion spring and serves as urging means. In the variable valve timing device 18 of the intake valve, torque of the intake camshaft 16 is applied in a direction for shifting the VCT phase in a retard direction. The above means that the spring 55 urges the rotor 35 to shift the VCT phase in the advance direction that is opposite from the direction of torque applied to the intake camshaft 16.

In the first embodiment, it is designed such that the force of the spring 55 is applied to the rotor 35 in the advance direction when the VCT phase stays within a range from the full retard position to a position immediately before the intermediate lock position. For example, the spring 55 is designed to work for a fail-safe operation during restarting the engine 11 after the engine 11 has abnormally stopped, such as an engine stall. More specifically, when the engine is started in a state, where the actual VCT phase is on a retard side of the intermediate lock position while the lock pin 58 is not fitted with the lock pin receiving hole 57, the spring force of the spring 55 assists an advance operation, in which the actual VCT phase is advanced from the retard side toward the intermediate lock position such that the lock pin 58 is fitted into the lock pin receiving hole 57 in order to lock the VCT phase, during the cranking by a starter (not shown).

In contrast, when the engine is started in another state, where the actual VCT phase is on an advance side of the intermediate lock position, torque of the intake camshaft 16 is applied in the retard direction during the cranking. As a result, the torque of the intake camshaft 16 retards the actual VCT phase from the advance side toward the intermediate lock position such that the lock pin 58 is engaged with the lock pin receiving hole 57 for locking the VCT phase.

Figure 4:
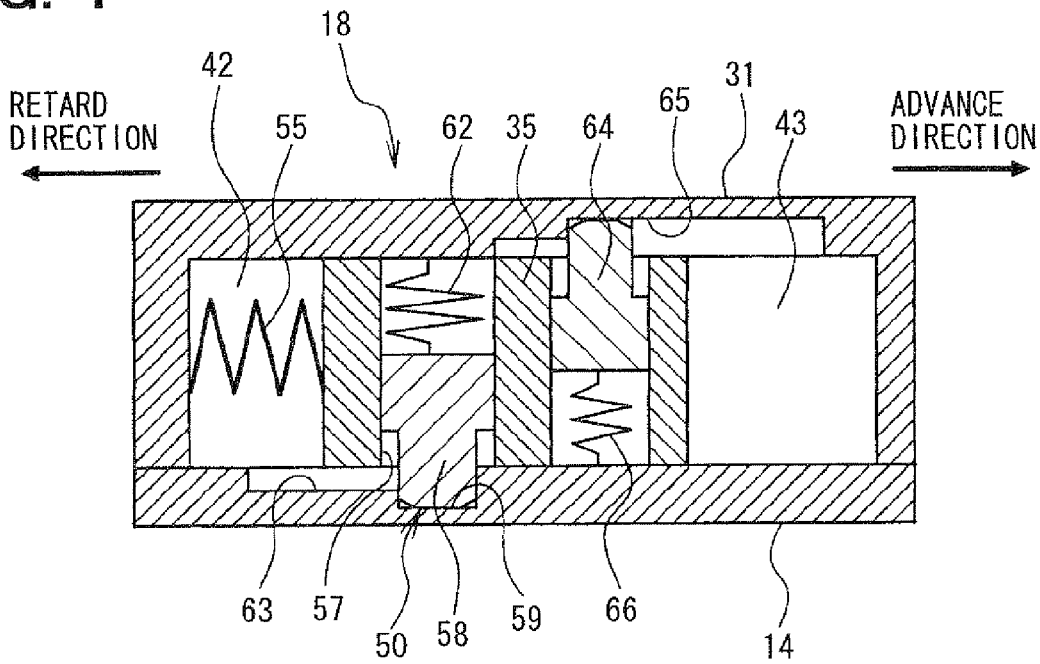
FIG. 4 is a longitudinal sectional view of the variable valve timing device for explaining function of a lock pin (advance limitation pin) and a retard limitation pin.

Also, as shown in FIG. 4, the lock pin 58 functions as an advance limitation pin that limits the VCT phase, which is controlled on the retard side of the intermediate lock position, from erroneously shifting to pass over the intermediate lock position to a position on the advance side of the intermediate lock position. Typically, a retard range limitation groove 63, which is shallower than the lock hole 59, is formed continuously from the lock hole 59. Thus, the fitting of the lock pin 58 (advance limitation pin) into the retard range limitation groove 63 limits the changeable range of the VCT phase controlled on the retard side of the intermediate lock position. When the target VCT phase is set on the advance side of the intermediate lock position, the oil pressure is caused to push the lock pin 58 (advance limitation pin) out of the retard range limitation groove 63 and out of the lock hole 59 such that the VCT phase is displaceable to the position on the advance side of the intermediate lock position.

Similarly, a retard limitation pin 64 and an advance range limitation groove 65 are provided for limiting the VCT phase, which is controlled on the advance side of the intermediate lock position, from erroneously shifting to pass over the intermediate lock position to a position on the retard side of the intermediate lock position. Typically, the fitting of the retard limitation pin 64 into the advance range limitation groove 65 by a force of a spring 66 limits the changeable range of the VCT phase, which is controlled on advance side of the intermediate lock position. When the target VCT phase is set on the retard side of the intermediate lock position, the oil pressure is caused to push the retard limitation pin 64 out of the advance range limitation groove 65 such that the VCT phase is made displaceable to a position on the retard side of the intermediate lock position.

Figure 5A:
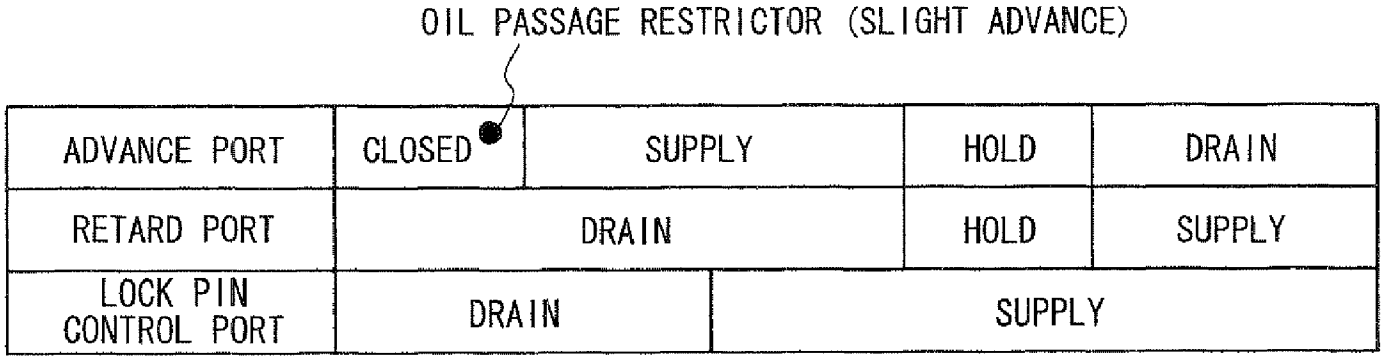
FIG. 5A is a diagram for explaining a switching pattern for switching an operational state of an advance port, a retard port, and a lock pin control port of a hydraulic control valve.
Figure 5B:
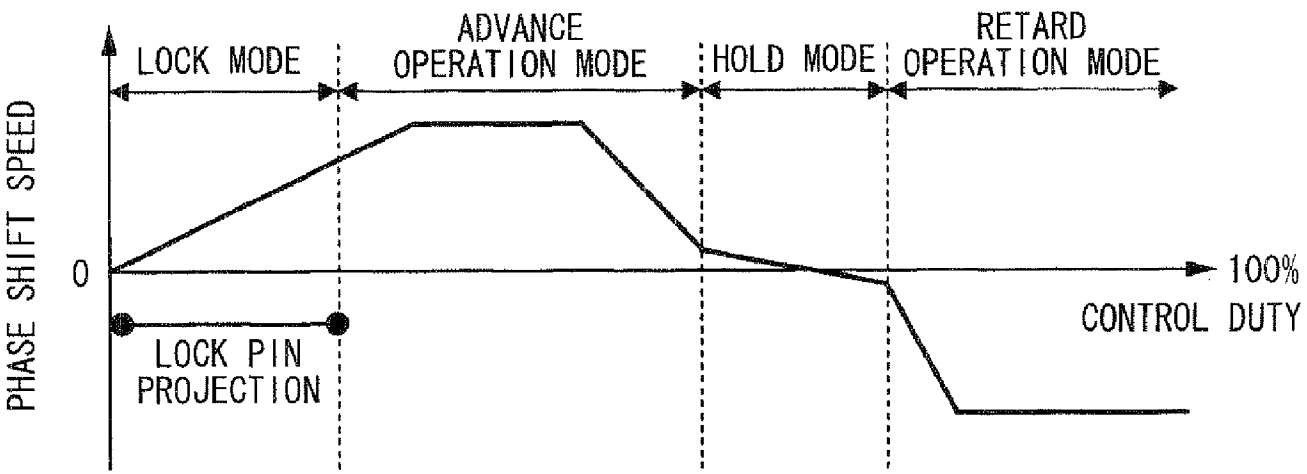
FIG. 5B is a control characteristic diagram of the hydraulic control valve for explaining a relation between (a) a phase change speed and (b) four control ranges of a control duty including a lock mode, an advance operation mode, a hold mode, a retard operation mode.

Also, in the first embodiment, the oil pressure control device controls oil pressure that actuates the VCT phase and the lock pin 58 of the variable valve timing device 18. The oil pressure control device of the present embodiment includes a hydraulic control valve 25 that is structured to function as a phase control hydraulic control valve and as a lock control hydraulic control valve. For example, the phase control hydraulic control valve controls oil pressure that actuates the VCT phase, and the lock control hydraulic control valve controls oil pressure that actuates the lock pin 58. In other words, the hydraulic control valve 25 integrally includes (a) first means for controlling oil pressure that actuates the VCT phase and (b) second means for controlling oil pressure that actuates the lock pin 58. An oil pump 28 is driven by drive force of the engine 11 and pumps oil (hydraulic oil) in an oil pan 27 to supply the oil to the hydraulic control valve 25. The above hydraulic control valve 25 is, for example, an eight-port and four-position spool valve. As shown in FIGS. 5A and 5B, the hydraulic control valve 25 is operated under four operational modes based on a control duty (control amount) of the hydraulic control valve 25. The operational modes have a lock mode (slight advance operation mode), an advance operation mode, a hold mode, and a retard operation mode, for example.

When the operation mode is the lock mode (slight advance operation mode), a lock pin control port of the hydraulic control valve 25 is brought into communication with the drain port such that oil pressure in the lock release oil pressure chamber within the lock pin receiving hole 57 is released, and thereby the spring 62 is allowed to displace the lock pin 58 in the lock direction (projection direction) without the counter force of the oil pressure that otherwise prevents the displacement of the lock pin 58 in the lock direction. Also, a retard port of the hydraulic control valve 25 is brought into communication with the drain port such that oil pressure in the retard chambers 43 are released. In the above communication state, a restrictor in an oil passage connected with an advance port of the hydraulic control valve 25 is slowly changed in accordance with the control duty of the hydraulic control valve 25 such that oil is slowly supplied to the advance chambers 42 through the advance port. As a result, the actual VCT phase is gently shifted in the advance direction.

When the operation mode is the advance operation mode, the retard port of the hydraulic control valve 25 is brought into communication with the drain port such that oil pressure in the retard chamber 43 is released. In the above operation state, oil pressure supplied to the advance chambers 42 through the advance port of the hydraulic control valve 25 is changed in accordance with the control duty of the hydraulic control valve 25. As a result, the actual VCT phase is shifted in the advance direction.

When the operation mode is the hold mode, oil pressure in both the advance chamber 42 and the retard chamber 43 are maintained such that the actual VCT phase is prevented from being shifted.

When the operation mode is the retard operation mode, the advance port of the hydraulic control valve 25 is brought into communication with the drain port such that oil pressures in the advance chambers 42 are released. In the above operation state, oil pressure supplied to the retard chambers 43 through the retard port of the hydraulic control valve 25 is changed in accordance with the control duty of the hydraulic control valve 25 such that the actual VCT phase is shifted in the retard direction.

When the operation mode is the control mode other than the lock mode (such as the retard operation mode, the hold mode, the advance operation mode), the lock release oil pressure chamber within the lock pin receiving hole 57 is filled with oil in order to increase oil pressure in the lock release oil pressure chamber. As a result, the increased pressure of oil pulls the lock pin 58 out of the lock hole 59 such that the lock of the lock pin 58 is released. In other words, the increased oil pressure disengages the lock pin 58 from the lock hole 59 such that the lock of the VCT phase by the lock pin 58 is released.

It should be noted that in the first embodiment, the control mode is changed in the order from the lock mode (slight advance operation mode), the advance operation mode, the hold mode, to the retard operation mode in accordance of the increase of the control duty of the hydraulic control valve 25. However, for example, the control mode may be alternatively changed in the order of the retard operation mode, the hold mode, the advance operation mode, and the lock mode (slight advance operation mode) in accordance with the increased of the control duty of the hydraulic control valve 25. Further alternatively, the control mode may be changed in the other order of the lock mode (slight advance operation mode), the retard operation mode, the hold mode, and the advance operation mode. Also, in a case, where a control range of the lock mode (slight advance operation mode) is directly adjacent to a control range of the retard operation mode, the operation of the hydraulic control valve 25 in the control range for the lock mode (slight advance operation mode) may be executed as follows. For example, in the lock mode, oil pressure in the lock release oil pressure chamber within the lock pin receiving hole 57 is released, and thereby the spring 62 is allowed to displace the lock pin 58 in the lock direction. Simultaneously, the advance port is brought into communication with the drain port such that oil pressure is the advance chamber 42 is released. In the above operation condition, an operational state of the restrictor of the oil passage connected with the retard port is slowly changed in accordance with the control duty of the hydraulic control valve 25 such that oil is slowly supplied to the retard chambers 43 through the retard port. As a result, the actual VCT phase is gently shifted in the retard direction.

The engine control circuit 21 computes the target VCT phase (target valve timing) based on the engine operational condition during the VCT phase feed-back control (variable valve timing control). Then, the control duty (control amount) of the hydraulic control valve 25 is feed-back controlled through, for example, a PD control such that oil pressure supplied to the advance chambers 42 and the retard chambers 43 of the variable valve timing device 18 is feed-back controlled in order to cause the actual camshaft phase of the intake camshaft 16 (actual valve timing of the intake valve) to become the target VCT phase (target valve timing).

Furthermore, when the rotation of the engine 11 is to be stopped, or in a process of deactivating the engine 11, the engine control circuit 21, upon the occurrence of a lock request, controls the hydraulic control valve 25 to execute a lock control (or a control under the lock mode), where the VCT phase is shifted toward the intermediate lock position and the lock pin 58 is allowed to be displaced to be fitted into the lock hole 59 in the projection direction such that the VCT phase is locked at the intermediate lock position.

Accordingly, during the engine start operation, the engine 11 is started in a state, where the VCT phase is locked at the intermediate lock position. In the conventional system, in which the full retard position is learned as a reference phase (0°CA), it requires a substantial time after the engine start operation has been completed until the operational state becomes a certain operational state for learning the full retard position. As a result, during a period until the reference phase (full retard position) has been learned after the engine start, the VCT phase has to be controlled with the unknown reference phase (full retard position). As a result, it was impossible to accurately control the VCT phase in the conventional art.

Thus, in the present embodiment, it is considered that the engine is started in a state, where the VCT phase is locked at the intermediate lock position during the engine start operation. Thus, in the variable valve timing device 18 provided with the intermediate lock mechanism 50, when the VCT phase is locked at the intermediate lock position, the intermediate lock position is firstly learned as the reference phase instead of the full retard position of the conventional art. The reference phase (intermediate lock position) is defined as, for example, 0°CA, and the phase on the advance side of the reference phase (intermediate lock position) is indicated by a crank angle of a positive value. Also, the phase on the retard side of the reference phase (intermediate lock position) is indicated by the crank angle of a negative value. Due to the above, it is possible to quickly learn the reference phase (intermediate lock position) during the engine start operation, and thereby it is possible to prevent the control of the VCT phase without knowing the reference phase (intermediate lock position) after the engine start operation has been completed.

In general, a difference measured between the intermediate lock position and the limit position located at an advance end or at a retard end of the adjustable range of the VCT phase varies due to the manufacturing variation. For example, the limit position corresponds to the full retard position or the full advance position. Thus, when the target VCT phase is set around the limit position, components of the variable valve timing device 18 (for example, the vane 41, the lock pin 58, the retard limitation pin 64) may collide with the wall at the limit position, and thereby unpleasant collision noise may be generated. In addition, the components may be damaged disadvantageously in the conventional structure. In the above, for example, the wall at the limit position corresponds to the stopper 56, the side wall of the retard range limitation groove 63, or the side wall of the advance range limitation groove 65.

As a countermeasure for the above disadvantage, in the first embodiment, a control prohibition range is defined at a predetermined range from the limit position (full retard position, full advance position) of the adjustable range of the VCT phase, and the VCT phase is limited from being controlled within the control prohibition range. For example, the predetermined range corresponds to a maximum variation range of a difference between the intermediate lock position and the limit position. Thus, the target VCT phase is designed to avoid the above control prohibition range. In other words, the target VCT phase is set at a position different from the control prohibition range. Due to the above configuration, even when the difference between the intermediate lock position and the limit position varies due to the manufacturing variation, the component, such as the vane 41 of the variable valve timing device 18, is prevented from colliding with the wall of the limit position, and thereby the generation of the collision noise and the damage of the component are effectively prevented.

Figure 6:
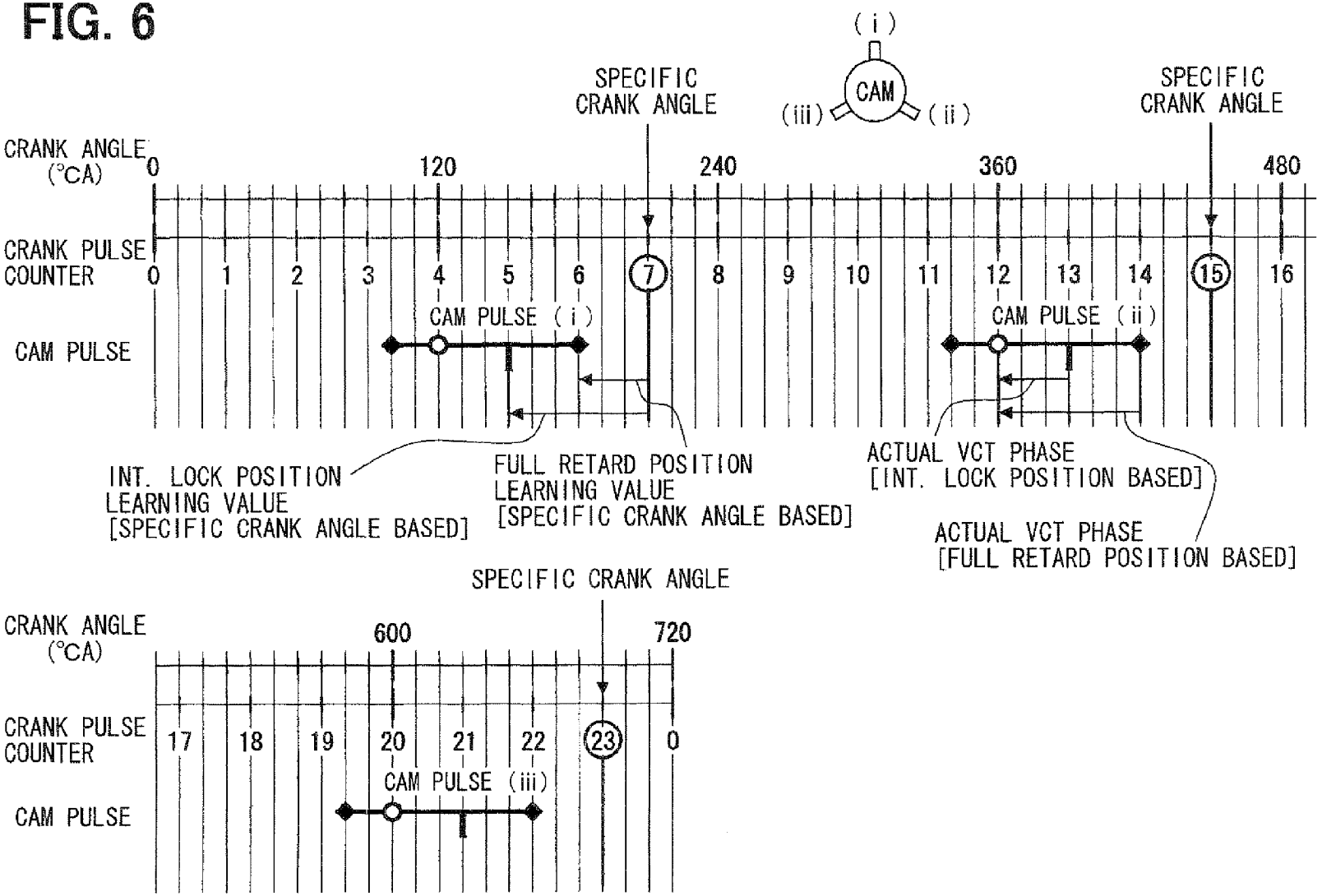
FIG. 6 is a diagram for explaining a relation between crank pulses and cam pulses and for explaining a method of learning an intermediate lock position and a method of computing the actual VCT phase.

A method for learning the intermediate lock position and a method for computing the actual VCT phase will be described with reference to FIG. 6. In the first embodiment, the crank angle sensor 20 outputs crank pulses at intervals of 30°CA, and the cam angle sensor 19 outputs cam pulses at intervals of 120°CA. The crank pulses outputted by the crank angle sensor 20 are counted by a crank pulse counter, and the counted value of the crank pulse counter is reset to be a minimum value "0" when the counted value becomes a maximum value "23". In the example of FIG. 6, a maximum adjustable crank angle width of the VCT phase is 80°CA, and a cam pulse phase is around 120°CA, 360°CA, and 600°CA, and the cam pulse phase is changeable by 80°CA at maximum in accordance to change of the VCT phase. A specific crank angle is set at 210°CA, 450°CA, and 690°CA in accordance with the cam pulse phase.

When the intermediate lock position is to be learned during the engine start operation, firstly the actual VCT phase during the engine start operation is learned as an intermediate lock position that is measured based on the specific crank angle, and the learning value of the intermediate lock position is stored, as a reference phase (0°CA), in a memory 30 (storage device) of the engine control circuit 21. The memory 30 storing the learning value of the intermediate lock position may be a RAM or may be a back-up RAM that is capable of keeping data by using the on-board battery as a back-up power source even when the ignition switch is off (when the engine is deactivated).

After the learning operation of learning the intermediate lock position has been completed, the actual VCT phase is computed by using the intermediate lock position learning value (or the learning value of the intermediate lock position) as the reference phase, and also the target VCT phase is computed in accordance with the engine operational condition by using the intermediate lock position learning value as the reference phase. In other words, the actual VCT phase and the target VCT phase are computed based on the learning value of the intermediate lock position. Then, pressure of oil supplied to the advance chambers 42 and the retard chambers 43 of the variable valve timing device 18 is F/B controlled by changing the control duty (control amount) of the hydraulic control valve 25 is F/B controlled through, for example, PD control such that the actual VCT phase becomes the target VCT phase.

Figure 7:
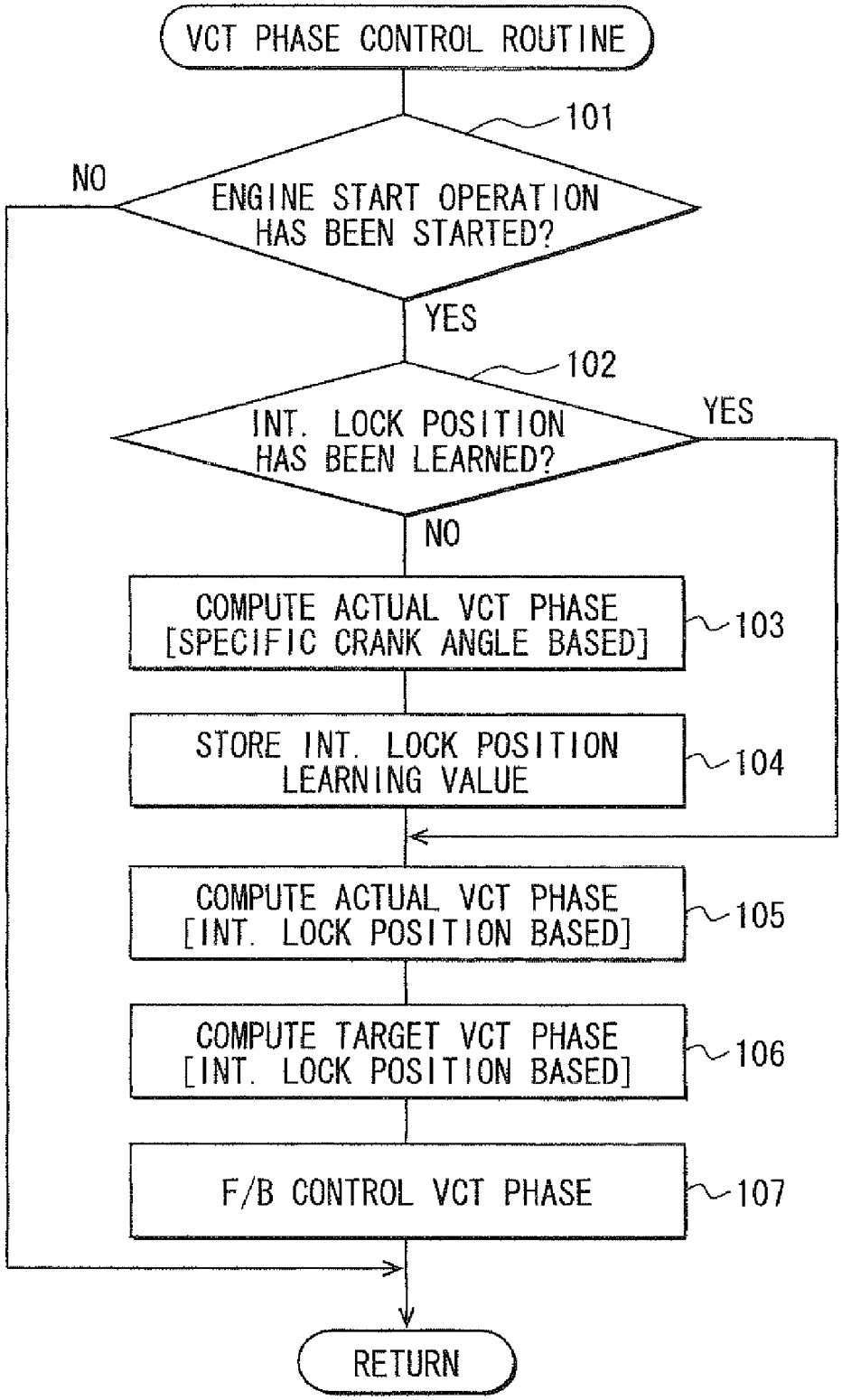
FIG. 7 is a flow chart illustrating a procedure of a VCT phase control routine according to the first embodiment.

The learning process of learning the intermediate lock position and control of the VCT phase in the first embodiment are executed by the engine control circuit 21 in accordance of the VCT phase control routine of FIG. 7.

The VCT phase control routine in FIG. 7 is repeatedly executed at predetermined intervals while the power source of the engine control circuit 21 is on (or the ignition switch is on). When the present routine is started, firstly, it is determined at step 101 whether the engine start operation has been started. When the engine start operation has not been started, the following process is not executed and the present routine is ended.

When it is determined at step 101 that the engine start operation has been started, control proceeds to step 102, where it is determined whether the learning operation of learning the intermediate lock position has been completed. In other words, it is determined at step 102 whether the intermediate lock position has been learned. When it is determined that the learning operation of learning the intermediate lock position has not been completed, control proceeds to step 103, where the actual VCT phase during the engine start operation is computed based on the specific crank angle. Then, control proceeds to step 104, where the computed value of the actual VCT phase during the engine start operation is stored as the intermediate lock position learning value in the memory of the engine control circuit 21. In the above, the VCT phase may not be locked at the intermediate lock position during the engine start operation. Thus, it is determined whether the computed value of the actual VCT phase during the engine start operation falls within a manufacturing variation range of the intermediate lock position, and when the computed value of the actual VCT phase during the engine start operation falls beyond the manufacturing variation range, it is estimated that the VCT phase is not locked at the intermediate lock position. In the above case, the computed value of the actual VCT phase during the engine start operation is not employed as the intermediate lock position learning value. In other words, in the above case, the intermediate lock position is prohibited from being learned. The process at steps 103 and 104 serves as intermediate lock position learning means.

At step 102, when it is determined that the learning operation of learning the intermediate lock position has been completed, the above intermediate lock position learning process at steps 103 and 104 is omitted.

Then, control proceeds to step 105, where the actual VCT phase is computed by using the intermediate lock position learning value as the reference phase. In other words, at step 105, the actual VCT phase is computed based on the learning value of the intermediate lock position. The process at step 105 serves as actual VCT phase computing means.

Then, control proceeds to step 106, where the target VCT phase is computed in accordance with the engine operational condition by using the intermediate lock position learning value as the reference phase. In other words, at step 106, the target VCT phase is computed in accordance with the engine operational condition based on the learning value of the intermediate lock position. In the above, a control prohibition range, in which the VCT phase is prevented from being controlled, is set within a predetermined range from the limit position (full retard position, full advance position) of the adjustable range of the VCT phase. The predetermined range corresponds to a maximum variation range of the difference between the intermediate lock position and the limit position. The target VCT phase is set at a position different from the control prohibition range. Process at step 106 serves as target VCT phase computing means.

Then, control proceeds to step 107, where the control duty of the hydraulic control valve 25 is FIB controlled such that the actual VCT phase becomes the target VCT phase. Process at step 107 serves as variable valve timing controlling means.

In the first embodiment, in the variable valve timing device 18 having the intermediate lock mechanism 50, the engine 11 is started in a state, where the VCT phase is locked at the intermediate lock position during the engine start operation. Because the above is considered, the actual VCT phase during the engine start operation is learned as the intermediate lock position, and the intermediate lock position learning value is used as the reference phase in the computation of the actual VCT phase and the target VCT phase. Thus, it is possible to substantially quickly learn the reference phase (intermediate lock position) during the engine start operation. As a result, it is possible to avoid the control of the VCT phase with the unknown reference phase (intermediate lock position) after the engine start operation has been completed. Instead, it is possible to accurately control the VCT phase based on the reference phase (intermediate lock position) that is learned during the engine start operation advantageously.

Furthermore, in the present embodiment, the control prohibition range is set within the predetermined range from the limit position (full retard position, full advance position) of the adjustable range of the VCT phase. More specifically, the control prohibition range corresponds to the maximum variation range of the difference between the intermediate lock position and the limit position, and the VCT phase is to be prevented from being controlled in the control prohibition range. Because the target VCT phase is set at the position different from the control prohibition range, even when the difference between the intermediate lock position and the limit position varies due to the manufacturing variation, the component, such as the vane 41 of the variable valve timing device 18, is effectively limited from colliding with the wall that defines the limit position. As a result, the collision noise and damage of the components are effectively prevented advantageously.

In the first embodiment, after the intermediate lock position has been learned, the limit position located on the retard side or the advance side of the adjustable range of the VCT phase may be learned by the limit position learning means. In other words, the full retard position or the full advance position may be learned by the limit position learning means after the intermediate lock position has been learned. Due to the above configuration, also in a case of learning the limit position, delay of the completion of the learning operation of the reference phase (intermediate lock position) is effectively prevented, and thereby it is possible to learn the reference phase (intermediate lock position) during the engine start operation. In the above case, after the completion of learning of the limit position, the adjustable range of the target VCT phase may be extended to the learning value of the limit position. Alternatively, after the limit position has been learned, the actual VCT phase and the target VCT phase may be computed by using the limit position learning value as the reference phase. In other words, after the limit position has been learned, the actual VCT phase and the target VCT phase may be computed based on the learning value of the limit position.

(Second Embodiment)

Next, the second embodiment of the present invention will be described with reference to FIGS. 8 to 11.

Similar to the first embodiment, the intermediate lock position learning means for learning the intermediate lock position while the VCT phase is locked at the intermediate lock position is also provided in the second embodiment. However, the followings are different from the first embodiment.

In the second embodiment, a provisional value of the full retard position is computed based on the intermediate lock position learning value. For example, the full retard position corresponds to the limit position on the retard side of the adjustable range of VCT phase. Then, the actual VCT phase is computed by using the full retard position provisional value as the reference phase, and the target VCT phase is computed in accordance with the engine operational condition by using the full retard position provisional value as the reference phase. Thus, pressure of oil supplied to the advance chambers 42 and the retard chambers 43 of the variable valve timing device 18 is FIB controlled through the F/B control of the control duty of the hydraulic control valve 25 such that the actual VCT phase becomes the target VCT phase.

In the above case, data of a difference (distance) measured between the intermediate lock position and the full retard position is required in the computation of the full retard position provisional value from the intermediate lock position learning value. The data of difference may employ, for example, a preset value or a median value, an average value, or a standard value of a manufacturing variation range.

Further, in the second embodiment, when a predetermined full retard position learning execution condition (a predetermined limit position learning execution condition) becomes satisfied during the engine operation, the full retard position is learned. When the learning operation of learning the full retard position has been completed, the actual VCT phase and the target VCT phase are computed by using the full retard position learning value as the reference phase. Also, when the learning operation of learning the full retard position has been completed, the intermediate lock position is learned by using the full retard position learning value as the reference phase while the VCT phase is locked at the intermediate lock position by the intermediate lock mechanism 50. Due to the above configuration, the controlling of the VCT phase using the full retard position provisional value as the reference phase is executed only until the learning operation of learning the full retard position is completed. As a result, it is possible to control the VCT phase using the full retard position learning value as the reference phase after the learning operation of learning the full retard position has been completed. Thereby, it is possible to accurately control the VCT phase advantageously.

Also, in the second embodiment, there is provided the back-up RAM 30 (see FIG. 1) that serves as a rewritable storage device capable of storing data of the full retard position learning value using the on-board battery as the back-up power source even while the engine 11 is at rest (or while the ignition switch is off). In a case, where data of the full retard position learning value in the back-up RAM 30 is cleared (or the back-up RAM 30 does not store therein the full retard position learning value) due to the detachment of the back-up power source of the back-up RAM 30 during the replacement of the on-board battery, the full retard position provisional value is computed based on the intermediate lock position learning value, the actual VCT phase and the target VCT phase are s computed using the full retard position provisional value as the reference phase. When data of the full retard position learning value in the back-up RAM 30 is stored (or when the back-up RAM 30 stores therein the full retard position learning value), the full retard position provisional value is limited from being computed. Instead, the full retard position learning value stored in the back-up RAM 30 is used as the reference phase to compute the actual VCT phase and the target VCT phase. Due to the above configuration, when the full retard position learning value is stored in the back-up RAM 30, the stored full retard position learning value is used as the reference phase to accurately control the VCT phase. Also, only when data of the full retard position learning value in the back-up RAM 30 is erroneously cleared due to the battery failure or battery clear, the full retard position provisional value is computed only when the engine is started for the first time after the erroneous clear of the data happened. Thus, computation load of the engine control circuit 21 during the engine start operation is effectively reduced.

Also, in the second embodiment, when data of the full retard position learning value is stored in the back-up RAM, the intermediate lock position is learned by using the full retard position learning value stored in the back-up RAM as the reference phase. Due to the above configuration, it is possible to accurately learn the intermediate lock position by using the full retard position learning value as the reference phase.

The learning process and control of the VCT phase in the second embodiment are executed by the engine control circuit 21 in accordance with a VCT phase control routine shown in FIGS. 8 and 9 as below.

Figure 8:
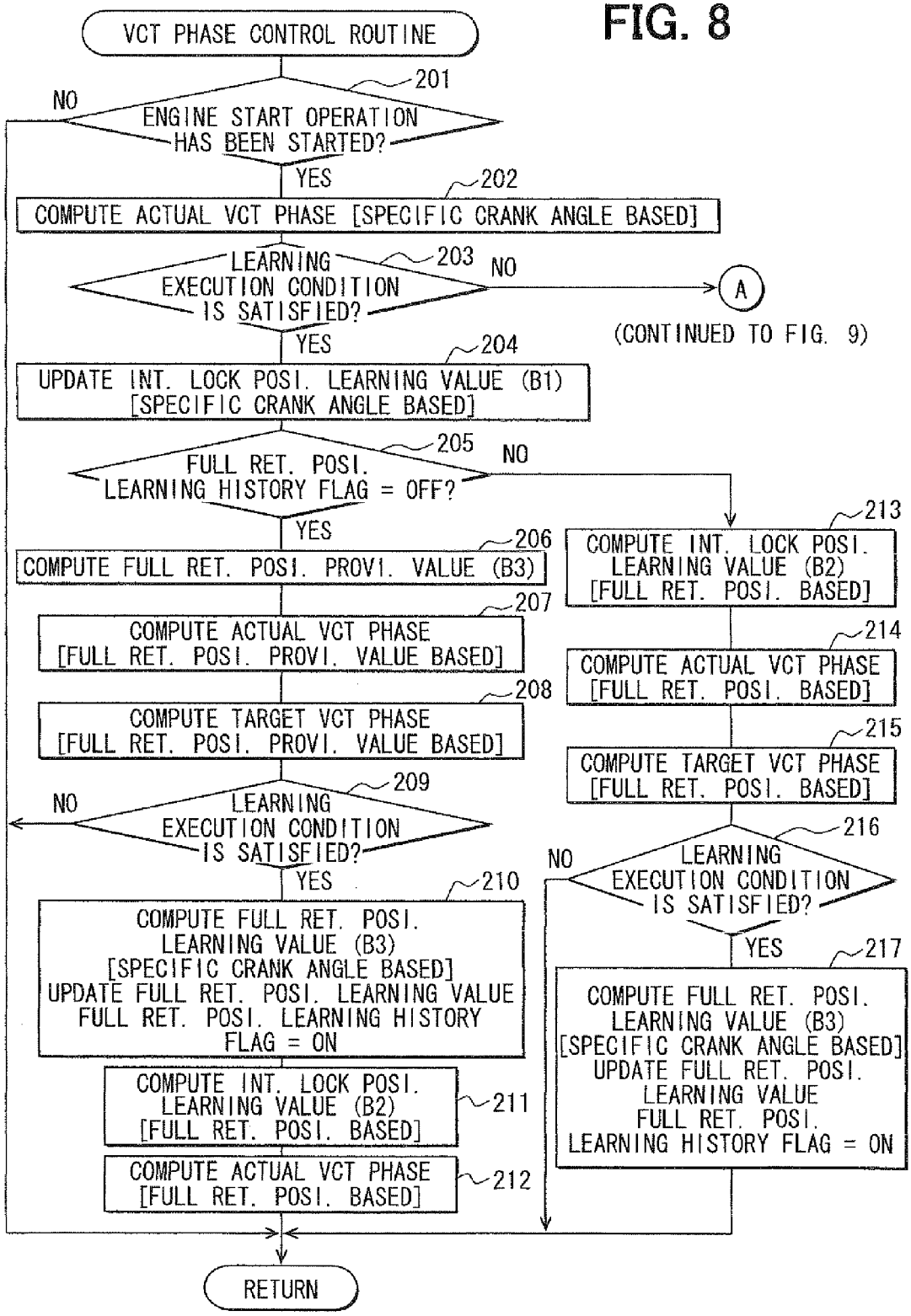
FIG. 8 is a flow chart illustrating a procedure of a VCT phase control routine according to the second embodiment.
Figure 9:
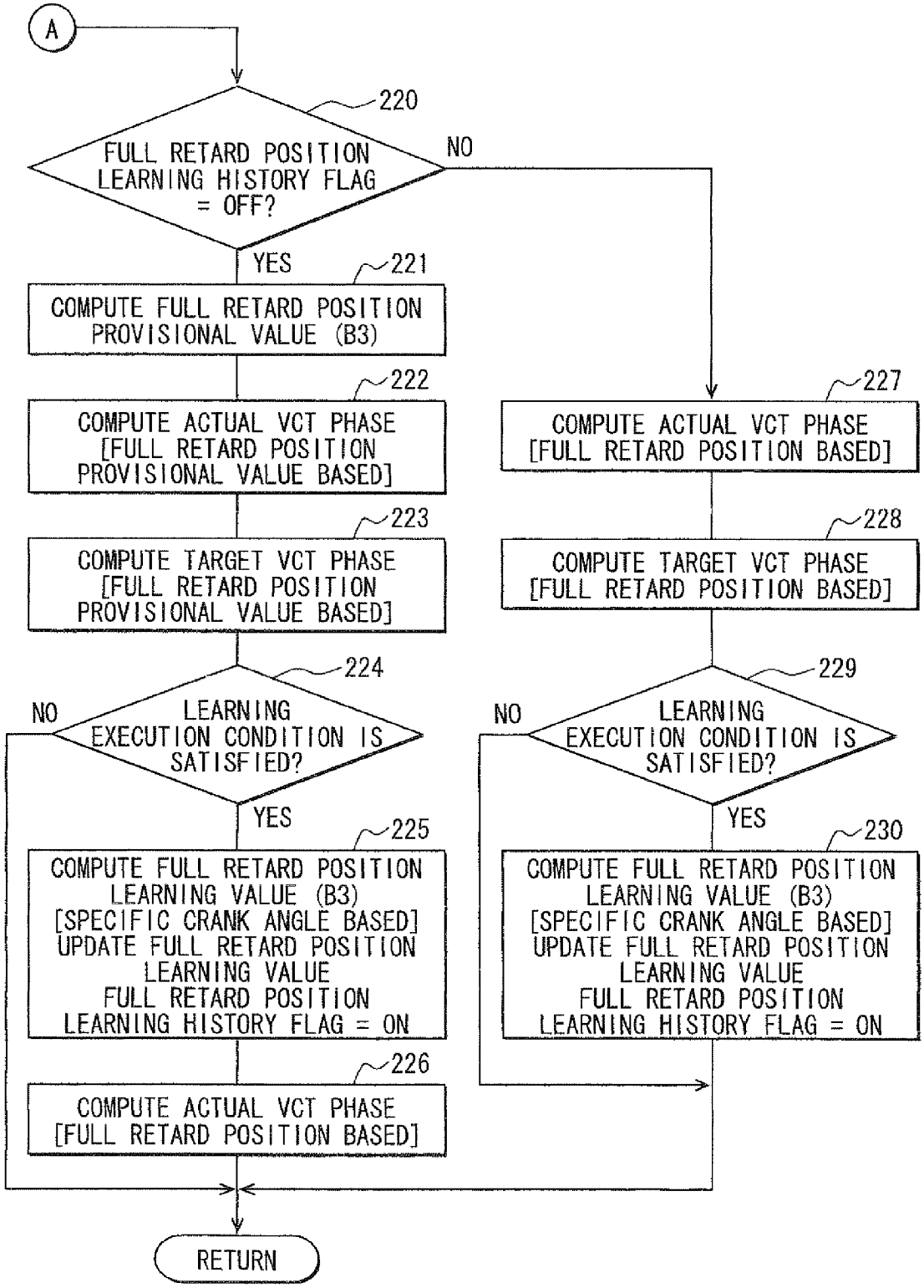
FIG. 9 is a flow chart continued from the flow chart of FIG. 8 for illustrating the VCT phase control routine according to the second embodiment.

The VCT phase control routine shown in FIG. 8 and FIG. 9 is repeatedly executed at predetermined intervals while the power source of the engine control circuit 21 is on (while the ignition switch is on). When the present routine is activated, firstly, control proceeds to step 201, where it is determined whether the engine start operation has been started. When it is determined that the engine start operation has not been started, the present routine is ended without executing the subsequent process.

When it is determined at step 201 that the engine start operation has been started, control proceeds to step 202, where the actual VCT phase is computed based on the specific crank angle. Then, control proceeds to step 203, where it is determined whether the intermediate lock position learning execution condition is satisfied by determining whether both of the following two conditions (1) and (2) are satisfied simultaneously, for example.

Condition (1): The intermediate lock position has not been learned.

Condition (2): The intermediate lock mechanism 50 locks the VCT phase at the intermediate lock position or the VCT phase is at a position, from which the intermediate lock mechanism 50 is capable of locking the VCT phase at the intermediate lock position.

When even one of the above two conditions (1) and (2) is not satisfied, the intermediate lock position learning execution condition is not established or satisfied.

When both of the above two conditions (1) and (2) are simultaneously satisfied, the intermediate lock position learning execution condition is satisfied. Thus, control proceeds to step 204, where it is estimated that the actual VCT phase computed at step 202 corresponds to the intermediate lock position, and thereby the computed value of the actual VCT phase is stored in the back-up RAM as the intermediate lock position learning value (B1).

Then, control proceeds to step 205, where it is determined whether a full retard position learning history flag is OFF, which corresponds to that there is no full retard position learning history. When data of the full retard position learning value in the back-up RAM is cleared due to the battery failure, such as the detachment of the back-up power source of the back-up RAM during the replacement of the on-board battery, the full retard position learning history flag becomes OFF. When it is determined at step 205 that the full retard position learning history flag is OFF (or that there is no full retard position learning history), control proceeds to step 206, where a full retard position provisional value [specific-crank-angle-based value] (B3) is computed by subtracting a difference a between the intermediate lock position and the full retard position from the intermediate lock position learning value [specific-crank-angle-based value].

full retard position provisional value[specific-crank-angle-based value]($B3$)=intermediate lock position learning value[specific-crank-angle-based value]$-\alpha$ The difference $\alpha$ between the intermediate lock position and the full retard position is a design value and may employ, for example, a preset value, a median, an average value, or a standard value within a manufacturing variation range.

Then, control proceeds to step 207, where the actual VCT phase [specific-crank-angle-based value] computed at step 202 is converted into the actual VCT phase [full-retard-position-provisional-value-based phase] that is computed based on the full retard position provisional value [specific-crank-angle-based value] as below.

actual VCT phase[full-retard-position-provisional-value-based phase]=actual VCT phase[specific-crank-angle-based value]−full retard position provisional value[specific-crank-angle-based value]

Then, control proceeds to step 208, where the target VCT phase is computed in accordance with the engine operational condition by using the full retard position provisional value [specific-crank-angle-based value] as the reference phase. Then, control proceeds to step 209, where it is determined whether the full retard position learning execution condition is satisfied, for example, by determining whether the following two conditions (1) and (2) are simultaneously satisfied.

Condition (1): The full retard position has not been learned.

Condition (2): The VCT phase is at a position, from which the VCT phase is controllable to the full retard position.

When even one of the above conditions (1) and (2) is not satisfied, it is determined that the full retard position learning execution condition is not satisfied, and thereby the present routine is ended without executing the subsequent process.

When the above two conditions (1) and (2) are simultaneously satisfied, it is determined that the full retard position learning execution condition is satisfied. Thus, control proceeds to step 210, where the full retard position [specific-crank-angle-based value] is computed in the following manner by executing a full retard position contact operation. More specifically, firstly, the VCT phase is forcibly displaced to a contact position, at which the lock pin 58 contacts a wall of the retard range limitation groove 63 that defines the full retard position. Then, the actual VCT phase [specific-crank-angle-based value] at the contact position is stored as a full retard position learning value [specific-crank-angle-based value] in the back-up RAM, and then the full retard position learning history flag is set as ON.

Then, control proceeds to step 211, where the intermediate lock position learning value [specific-crank-angle-based value] computed at step 204 is converted into an intermediate lock position learning value [full-retard-position-based value] by using the full retard position learning value [specific-crank-angle-based value] as the reference value.

intermediate lock position learning value[full-retard-position-based value]($B2$)=intermediate lock position learning value[specific-crank-angle-based value]($B1$)−full retard position learning value[specific-crank-angle-based value]($B3$)

Then, control proceeds to step 212, where the actual VCT phase [specific-crank-angle-based value] computed at step 202 is converted into the actual VCT phase [full-retard-position-based value] based on the full retard position learning value [specific-crank-angle-based value].

actual VCT phase[full-retard-position-based value]=actual VCT phase[specific-crank-angle-based value]−full retard position learning value[specific-crank-angle-based value]

In contrast, when it is determined at step 205 that the full retard position learning history flag is ON (or that there is the full retard position learning history), control proceeds to step 213, where the intermediate lock position learning value [specific-crank-angle-based value] computed at step 204 is converted into an intermediate lock position learning value [full-retard-position-based value] by using the full retard position learning value [specific-crank-angle-based value] stored in the back-up RAM as the reference value.

intermediate lock position learning value[full-retard-position-based value]($B2$)=intermediate lock position learning value[specific-crank-angle-based value]($B1$)−full retard position learning value[specific-crank-angle-based value]($B3$)

Then, control proceeds to step 214, where the actual VCT phase [specific-crank-angle-based value] computed at step 202 is converted into the actual VCT phase [full-retard-position-based value] based on the full retard position learning value [specific-crank-angle-based value].

the actual VCT phase[full-retard-position-based value]=actual VCT phase[specific-crank-angle-based value]−full retard position learning value [specific-crank-angle-based value]

Then, control proceeds to step 215, where the target VCT phase is computed in accordance with the engine operational condition by using the full retard position learning value as the reference phase.

Then, control proceeds to step 216, where it is determined whether the full retard position learning execution condition is satisfied in a method similar to that in step 209. When it is determined that the full retard position learning execution condition is not satisfied, the present routine is ended. In contrast, when it is determined that the full retard position learning execution condition is satisfied, control proceeds to step 217, where a full retard position [specific-crank-angle-based value] is learned in a method similar to that in step 210. Then, the actual VCT phase [specific-crank-angle-based value] at the contact position, at which the lock pin 58 contacts the wall defining the full retard position, is stored in the back-up RAM as the full retard position learning value [specific-crank-angle-based value]. Also, the full retard position learning history flag is set as ON.

Also, when it is determined at step 203 that the intermediate lock position learning execution condition is not satisfied, control proceeds to step 220 in FIG. 9, where it is determined whether the full retard position learning history flag is OFF, which corresponds to that there is no full retard position learning history. When data of the full retard position learning value in the back-up RAM is cleared due to the battery failure, such as the disconnection of the back-up power source of the back-up RAM at the time of replacing the on-board battery, the full retard position learning history flag has been OFF. When it is determined at step 220 that the full retard position learning history flag is OFF (or that there is no full retard position learning history), control proceeds to step 221, where the full retard position provisional value [specific-crank-angle-based value](B3) is computed by subtracting the difference $\alpha$ between the intermediate lock position and the full retard position from the intermediate lock position initial value [specific-crank-angle-based value].

full retard position provisional value[specific-crank-angle-based value]($B3$)=intermediate lock position initial value[specific-crank-angle-based value]−$\alpha$ The difference $\alpha$ between the intermediate lock position and the full retard position is a design value and may employ, for example, a preset value or a median, an average value, or a standard value within the manufacturing variation range.

Also, the following equation is satisfied.

intermediate lock position initial value[full-retard-position-based value]=$\alpha$ Then, control proceeds to step 222, where the actual VCT phase [specific-crank-angle-based value] computed at step 202 is converted into the actual VCT phase [full-retard-position-provisional-value-based phase] by using the full retard position provisional value [specific-crank-angle-based value] as the reference value.

actual VCT phase[full-retard-position-provisional-value-based phase]=actual VCT phase[specific-crank-angle-based value]−full retard position provisional value[specific-crank-angle-based value]

Then, control proceeds to step 223, where the target VCT phase is computed in accordance with the engine operational condition by using the full retard position provisional value as the reference phase.

Then, control proceeds to step 224, where it is determined whether the full retard position learning execution condition is satisfied in a method similar to that in step 209. When it is determined that the full retard position learning execution condition is not satisfied, the present routine is ended. In contrast, when it is determined that the full retard position learning execution condition is satisfied, control proceeds to step 225, where the full retard position [specific-crank-angle-based value] is learned in a method similar to that in step 210. Then, the actual VCT phase [specific-crank-angle-based value] at the contact position, at which the lock pin 58 contacts the wall defining the full retard position, is stored in the back-up RAM 30 as the full retard position learning value [specific-crank-angle-based value], and the full retard position learning history flag is set as ON.

Then, control proceeds to step 226, where the actual VCT phase [specific-crank-angle-based value] computed at step 202 is converted into the actual VCT phase [full-retard-position-based value] based on the full retard position learning value [specific-crank-angle-based value].

actual VCT phase[full-retard-position-based value] =actual VCT phase[specific-crank-angle-based value]−full retard position learning value[specific-crank-angle-based value]

In contrast, when it is determined at step 220 that the full retard position learning history flag is ON (or that there is the full retard position learning history), control proceeds to step 227, where the actual VCT phase [specific-crank-angle-based value] computed at step 202 is converted into the actual VCT phase [full-retard-position-based value] based on the full retard position learning value [specific-crank-angle-based value] stored in the back-up RAM.

actual VCT phase[full-retard-position-based value] =actual VCT phase[specific-crank-angle-based value]−full retard position learning value[specific-crank-angle-based value]

Then, control proceeds to step 228, where the target VCT phase is computed in accordance with the engine operational condition by using the full retard position learning value as the reference phase.

Then, control proceeds to step 229, where it is determined whether the full retard position learning execution condition is satisfied in a method similar to that in step 209. When it is determined that the full retard position learning execution condition is not satisfied, the present routine is ended. In contrast, when it is determined that the full retard position learning execution condition is satisfied, control proceeds to step 230, where the full retard position [specific-crank-angle-based value] is learned in a method similar to that in step 210. Then, the actual VCT phase [specific-crank-angle-based value]VCT phase at the contact position, at which the lock pin 58 contacts the wall defining the full retard position, is stored in the back-up RAM as the full retard position learning value [specific-crank-angle-based value], and the full retard position learning history flag is set as ON.

Figure 10:
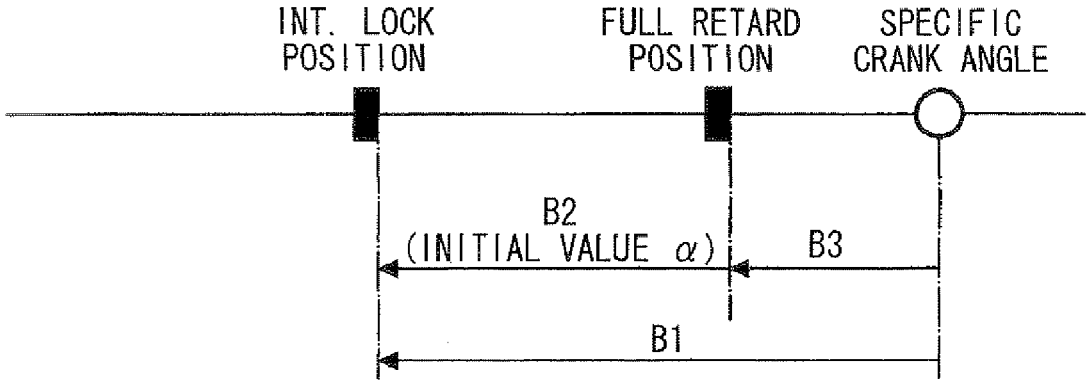
FIG. 10 is a diagram for explaining a relation between a specific crank angle, an intermediate lock position, and a full retard position.

FIG. 10 illustrates a relation between the intermediate lock position learning value [specific-crank-angle-based value] (B1), the intermediate lock position learning value [full-retard-position-based value] (B2), and the full retard position learning value [specific-crank-angle-based value] (B3). For example, the intermediate lock position learning value [specific-crank-angle-based value] (B1) is measured between the specific crank angle and the intermediate lock position. The intermediate lock position learning value [full-retard-position-based value] (B2) is measured between the full retard position and the intermediate lock position. The full retard position learning value [specific-crank-angle-based value] (B3) is measured between the specific crank angle and the full retard position.

Figure 11:
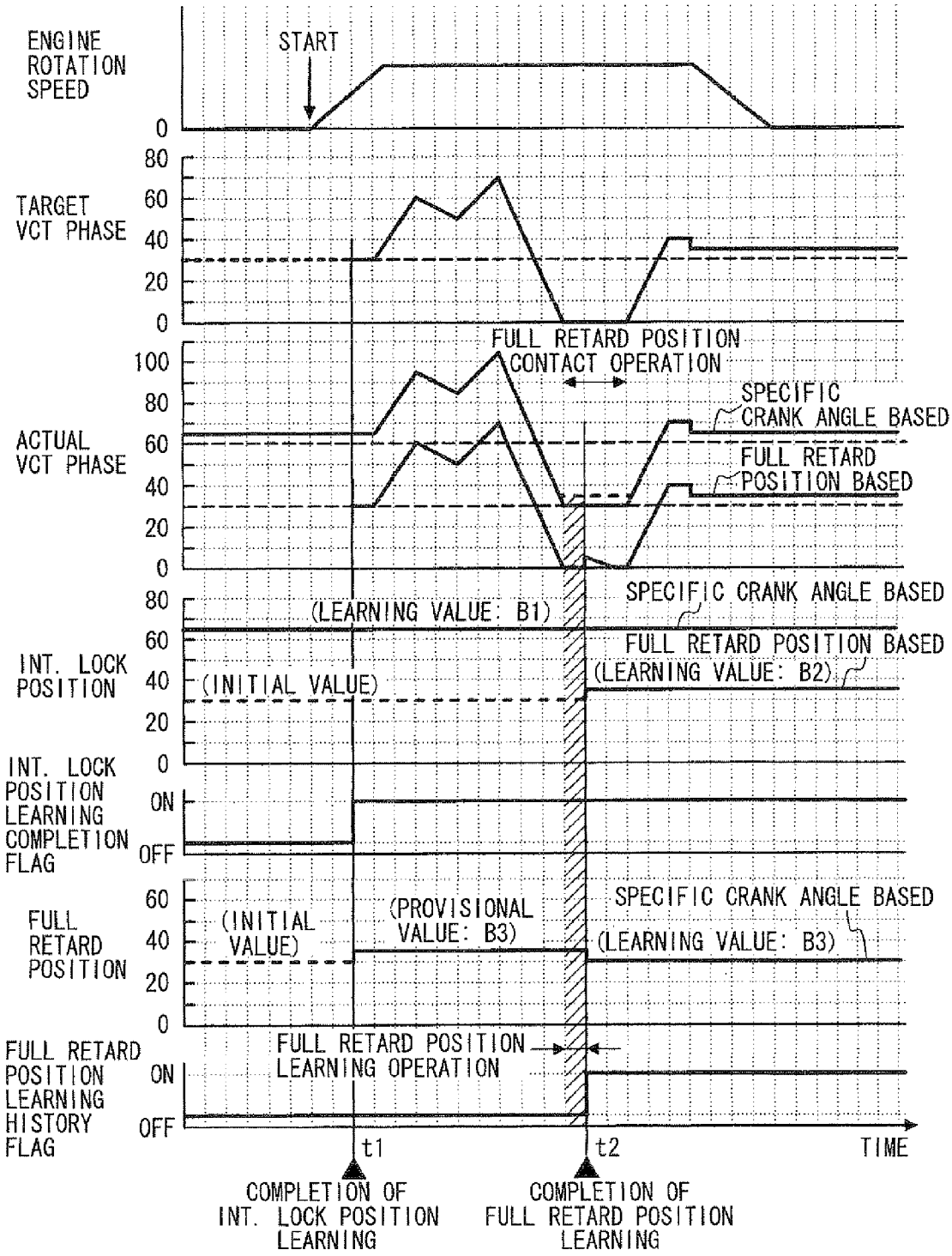
FIG. 11 is a timing chart illustrating a control example of correcting the target VCT phase and the actual VCT phase for an example case, where the intermediate lock position is different from a design value by 5°CA according to the second embodiment.

FIG. 11 is a timing chart illustrating a control example of correcting the target VCT phase and the actual VCT phase when the engine is started for the first time after the battery clear for an example structure, in which the intermediate lock position is erroneously different from a design value by 5°CA. In the example of FIG. 11, after the engine is started, when the intermediate lock position has been learned at time t1, the full retard position provisional value [specific-crank-angle-based value] (B3) is computed based on the intermediate lock position learning value [specific-crank-angle-based value] (B1). Then, the actual VCT phase and the target VCT phase are computed by using the full retard position provisional value [specific-crank-angle-based value] as the reference phase, and the control duty of the hydraulic control valve 25 is FIB controlled such that the actual VCT phase becomes the target VCT phase.

When the full retard position has been learned at time t2, the actual VCT phase is computed by using the full retard position learning value as the reference phase, and simultaneously the intermediate lock position is learned by using the full retard position learning value as the reference phase. Then, the target VCT phase is computed in accordance with the engine operational condition by using the full retard position learning value as the reference phase. As above, the target VCT phase and the actual VCT phase are corrected by an amount equivalent to the amount (5°CA) different from the design value.

In the second embodiment, the provisional value of the full retard position is computed based on the intermediate lock position learning value, and the actual VCT phase is computed by using the full retard position provisional value as the reference phase. Then, the target VCT phase is computed in accordance with the engine operational condition by using the full retard position provisional value as the reference phase. Thus, the control duty of the hydraulic control valve 25 is FIB controlled such that the actual VCT phase becomes the target VCT phase. As a result, it is possible to quickly compute the reference phase (full retard position provisional value) during the engine start operation. Thereby, it is possible to prevent the control of the VCT phase without knowing the reference phase (full retard position provisional value) after the engine start operation has been completed. As a result, it is possible to accurately control the VCT phase by using the reference phase (full retard position provisional value) computed during the engine start operation as the reference value. Furthermore, because it is possible to control the VCT phase by using the full retard position as the reference phase similar to the prior art, it is possible to reduce the modification of software when the present embodiment is practiced. As a result, it is possible to achieve the present embodiment at low cost. For example, when the reference phase (full retard position provisional value) is set at Q'CA, it is advantageously set all of the adjustable range of VCT phase at the crank angle of positive values.

It is noted that the present invention is not limited to the above first and second embodiments. For example, a hydraulic control valve, which controls oil pressure for actuating the VCT phase, may be alternatively separate from another hydraulic control valve, which controls oil pressure for actuating the lock pin 58 to perform the lock control.

Note that, the present invention is embodied as the variable valve timing control apparatus of the intake valve in the above first and second embodiments. However, the present invention may be alternatively applicable to a variable valve timing control apparatus of the exhaust valve. In the alternative case, where the present invention is applied to the variable valve timing control apparatus of the exhaust valve, a direction of controlling the VCT phase of the exhaust valve may be alternatively set opposite from the direction of controlling the VCT phase of the intake valve in the above embodiment. In other words, a directional relation between "timing advance"

and "timing retard" in the above embodiment may be reversed in the alternative embodiment for the exhaust valve.

The present invention may be modified in a various manner provided that the modification does not deviate from the gist of the present invention. For example, a configuration of the variable valve timing device 18 and a configuration of the hydraulic control valve 25 may be modified as required.

Additional advantages and modifications will readily occur to those skilled in the art. The invention in its broader terms is therefore not limited to the specific details, representative apparatus, and illustrative examples shown and described.

What is claimed is:

1. A variable valve timing control apparatus for an internal combustion engine having a crankshaft and a camshaft, comprising:

a hydraulic variable valve timing device configured to adjust valve timing by changing a variable cam timing (VCT) phase that is a rotational phase of the camshaft relative to the crankshaft;

an intermediate lock mechanism configured to lock the VCT phase at an intermediate lock position located between a full retard position and a full advance position of an adjustable range of the VCT phase;

an oil pressure control device configured to control oil pressure that actuates the variable valve timing device and the intermediate lock mechanism, wherein the oil pressure control device causes the intermediate lock mechanism to lock the VCT phase at the intermediate lock position when rotation of the internal combustion engine is to be stopped;

intermediate lock position learning means for learning the intermediate lock position as a reference phase to obtain a learning value of the intermediate lock position when the intermediate lock mechanism locks the VCT phase at the intermediate lock position;

actual VCT phase computing means for computing an actual VCT phase based on the learning value of the intermediate lock position;

target VCT phase computing means for computing a target VCT phase in accordance with an operational condition of the internal combustion engine based on the learning value of the intermediate lock position; and variable valve timing controlling means for controlling a control amount of the oil pressure control device such that the actual VCT phase becomes the target VCT phase.

2. The variable valve timing control apparatus according to claim 1, further comprising:

limit position learning means for learning a limit position of the adjustable range of the VCT phase in order to obtain a learning value of the limit position after the intermediate lock position learning means has learned the intermediate lock position, wherein the limit position is located on a retard side or on an advance side of the adjustable range of the VCT phase.

3. The variable valve timing control apparatus according to claim 1, wherein:

the target VCT phase computing means defines that a control prohibition range corresponds to a predetermined range from a limit position of the adjustable range of the VCT phase, the limit position being located on a retard side or on an advance side of the adjustable range of the VCT phase; and the target VCT phase computing means sets the target VCT phase at a position different from the control prohibition range.

4. The variable valve timing control apparatus according to claim 2, wherein:

the target VCT phase computing means defines that a control prohibition range corresponds to a predetermined range from the limit position of the adjustable range of the VCT phase; and the target VCT phase computing means sets the target VCT phase at a position different from the control prohibition range until the limit position learning means has learned the limit position.

5. A variable valve timing control apparatus for an internal combustion engine having a crankshaft and a camshaft, comprising:

a hydraulic variable valve timing device configured to adjust valve timing by changing a variable cam timing (VCT) phase that is a rotational phase of the camshaft relative to the crankshaft;

an intermediate lock mechanism configured to lock the VCT phase at an intermediate lock position located between a full retard position and a full advance position of an adjustable range of the VCT phase, an oil pressure control device configured to control oil pressure that actuates the variable valve timing device and the intermediate lock mechanism, wherein the oil pressure control device causes the intermediate lock mechanism to lock the VCT phase at the intermediate lock position when rotation of the internal combustion engine is to be stopped;

intermediate lock position learning means for learning the intermediate lock position as a reference phase to obtain a learning value of the intermediate lock position when the intermediate lock mechanism locks the VCT phase at the intermediate lock position;

limit position provisional value computing means for computing a provisional value of a limit position of the adjustable range of the VCT phase based on the learning value of the intermediate lock position, the limit position being located on a retard side or on an advance side of the adjustable range of the VCT phase;

actual VCT phase computing means for computing an actual VCT phase based on the provisional value of the limit position;

target VCT phase computing means for computing a target VCT phase in accordance with an operational condition of the internal combustion engine based on the provisional value of the limit position; and variable valve timing controlling means for controlling a control amount of the oil pressure control device such that the actual VCT phase becomes the target VCT phase.

6. The variable valve timing control apparatus according to claim 5, further comprising:

limit position learning means for learning the limit position of the adjustable range to obtain a learning value of the limit position when a predetermined limit position learning execution condition is satisfied while the internal combustion engine is operated, wherein:

the actual VCT phase computing means computes the actual VCT phase based on the learning value of the limit position after the limit position learning means has learned the limit position;

the target VCT phase computing means computes the target VCT phase based on the learning value of the limit position after the limit position learning means has learned the limit position; and the intermediate lock position learning means learns the intermediate lock position based on the learning value of the limit position when the intermediate lock mechanism locks the VCT phase at the intermediate lock position after the limit position learning means has learned the limit position.

7. The variable valve timing control apparatus according to claim 6, further comprising:

a rewritable storage device that stores the learning value of the limit position by using an on-board battery as a back-up power source even while the internal combustion engine is at rest, wherein:

when the storage device does not store therein the learning value of the limit position, the limit position provisional value computing means computes the provisional value of the limit position, and the actual VCT phase and the target VCT phase are computed based on the computed provisional value of the limit position; and when the storage device stores therein the learning value of the limit position, the limit position provisional value computing means is limited from computing the provisional value of the limit position, and the actual VCT phase and the target VCT phase are computed based on the learning value of the limit position stored in the storage device.

8. The variable valve timing control apparatus according to claim 7, wherein:

when the storage device stores therein the learning value of the limit position, the intermediate lock position learning means learns the intermediate lock position based on the learning value of the limit position stored in the storage device.

* * * * *